United States Patent [19]

Tsukahara et al.

[11] Patent Number: 4,711,616

[45] Date of Patent: Dec. 8, 1987

[54] CONTROL APPARATUS FOR A VARIABLE DISPLACEMENT PUMP

[75] Inventors: Kenji Tsukahara, Obu; Taizou Abe, Chiryu, both of Japan

[73] Assignee: Nippondenso Co., Ltd., Kariya, Japan

[21] Appl. No.: 808,836

[22] Filed: Dec. 12, 1985

[30] Foreign Application Priority Data

Dec. 13, 1984 [JP] Japan ..... 59-264257
Dec. 17, 1984 [JP] Japan ..... 59-267121

[51] Int. Cl.[4] ..... F04B 1/06

[52] U.S. Cl. ..... 417/216; 417/219; 60/447

[58] Field of Search ..... 417/216, 218–222, 417/212, 213; 60/447

[56] References Cited

U.S. PATENT DOCUMENTS

| | | | |
|---|---|---|---|
| 2,630,681 | 3/1953 | Ferris | 60/447 |
| 3,708,250 | 1/1973 | Thumm | 417/221 |
| 3,935,706 | 2/1976 | Stevens | 60/450 |
| 3,985,472 | 10/1976 | Virtue et al. | 417/216 |
| 4,032,260 | 6/1977 | Bosch | 417/216 |
| 4,080,979 | 3/1978 | Hein | 417/216 X |
| 4,132,506 | 1/1979 | Dantlgraber | 417/218 |
| 4,245,962 | 1/1981 | Uehara et al. | 417/218 |
| 4,292,805 | 10/1981 | Acheson | 417/218 X |
| 4,398,869 | 8/1983 | Kirkham et al. | 417/216 |
| 4,480,438 | 11/1984 | Breeden | 60/447 X |
| 4,509,902 | 4/1985 | Knodel et al. | 417/220 X |

FOREIGN PATENT DOCUMENTS

| | | | |
|---|---|---|---|
| 58-18582 | 2/1983 | Japan | 417/220 |
| 58-187590 | 11/1983 | Japan | 417/216 |
| 59-70891 | 4/1984 | Japan | 417/220 |

*Primary Examiner*—Carlton R. Croyle
*Assistant Examiner*—Paul F. Neils
*Attorney, Agent, or Firm*—Cushman, Darby & Cushman

[57] ABSTRACT

A control apparatus for a variable displacement pump includes a variable displacement pump having an inlet port and a discharge port driven by an external engine. A piston assembly is provided for varying the amount of displacement of the pump. The control apparatus further includes a switching valve for switching operational fluid which is to be applied to and operates the piston assembly, an additional pump a control pressure a magnitude of which is proportional to the rotational speed of the external engine, a balance piston for transducing the control pressure from the additional pump into a force and for applying the force to one end of the switching valve. A discharge line is provided connecting the discharge port of the variable displacement pump with an external load, and a pilot line is branched off from the discharge line into the switching valve for applying a pressure in the discharge line to the other end of the switching valve.

11 Claims, 13 Drawing Figures

CONTROL APPARATUS FOR A VARIABLE DISPLACEMENT PUMP

FIELD OF INVENTION AND RELATED ART STATEMENT

The invention relates to a control apparatus for a variable displacement pump, and is applicable for example to high pressure fuel pumps for diesel engines or oil-hydraulic pumps for industrial use.

Lately, there has been a necessity for providing a new type of high pressure fuel pump for diesel engines. This concerns a fuel feed pump for an injection system generally called the "common-rail injection system" (a system of feeding individual fuel injection valves provided for respective cylinders through a single common fuel feed piping). In this type of fuel pump, it is usually required to provide a delivery pressure proportional to the rotational speed of an associated diesel engine, that is, the fuel feed should be effected under relatively low pressures when the engine speed is low and under higher pressures when the engine speed is high. This is because of the fact that at low engine speeds, a prolonged or slow fuel injection for performance of slow burning of the charge is generally satisfactory in respect of noises, emission, etc. while at high engine speeds, a rapid injection of a great quantity of fuel under high pressures is meritorious in view of thermal efficiency. To meet this requirement, there have been proposed approaches relating to the diesel engine region, e.g. attempts for provision of a nozzle of variable crosssection in the fuel injection valve, or for multi-injection at the low engine speed (fuel injection is effected intermittently and gradually). Nevertheless, a number of technical difficulties have been encountered in those approaches.

The invention, in contrast, is based on a proposition made in the fuel feed pump region to meet the necessities described above.

In the conventional apparatus for delivery control of a variable displacement pump, as typically disclosed in Japanese Patent Unexamined Publication No. 58-18582, it is designed such that the eccentricity of the cam ring with respect to the rotor be controllable against a biasing spring by introducing pump delivery pressures to a control piston. The conventional control apparatus, therefore, has had the problem of being unable to increase the delivery pressure in response to an increase in the rotational speed of the external engine.

Further, the conventional control apparatus for a variable displacement pump, as disclosed in Japanese Patent Unexamined Publication Nos. 59-70891 and 58-187590, is of a control arrangement wherein the eccentricity between the rotor end the cam ring is varied to control the volume of delivery from the variable displacement pump by switching the fluid flow to either a low pressure on the tank side or the delivery pressure by means of a control valve or regulating valve. Hence, it is arranged that as the delivery control proceeds, a fraction of the fluid volume discharged from the pump is exhausted to the tank side (or suction line side). In other words, each time the displacement control is carried out, there will be an outflow of the high pressure fluid delivered from the pump. Accordingly, the pump has to deliver a volume of fluid to be employed for delivery control in addition to its primary output required by a load to which the pump is applied. This of course is inefficient in respect to power economy, and is particularly so when the control occurs frequently (in case of the common-rail injection system, corresponds to terminations of fuel injection) or the delivery pressure is high, since power losses due to the outflow of fluid for displacement control are objectionably increased.

OBJECTS AND SUMMARY OF THE INVENTION

The invention, therefore, has an object to provide a control apparatus which is capable of solving these problems.

To this end, according to one aspect of the invention, there is provided a control apparatus for a variable displacement pump which comprises:

- a variable displacement pump rotatingly driven by an external engine;
- means for varying the amount of displacement of said pump;
- valve means for switching operational fluid which is to be applied to and operates said varying means;
- means for generating a control pressure a magnitude of which is proportional to the rotational speed of said external engine;
- means for transducing the control pressure from said generating means into a force and for applying said force to one end of said valve means;
- a discharge line connecting said discharge port of said pump with an external load; and
- a pilot line branched off from said discharge line into said valve means for applying a pressure in said discharge line to the other end of said valve means.

DETAILED DESCRIPTION OF PREFERRED EMBODIMENTS

Figure 1:
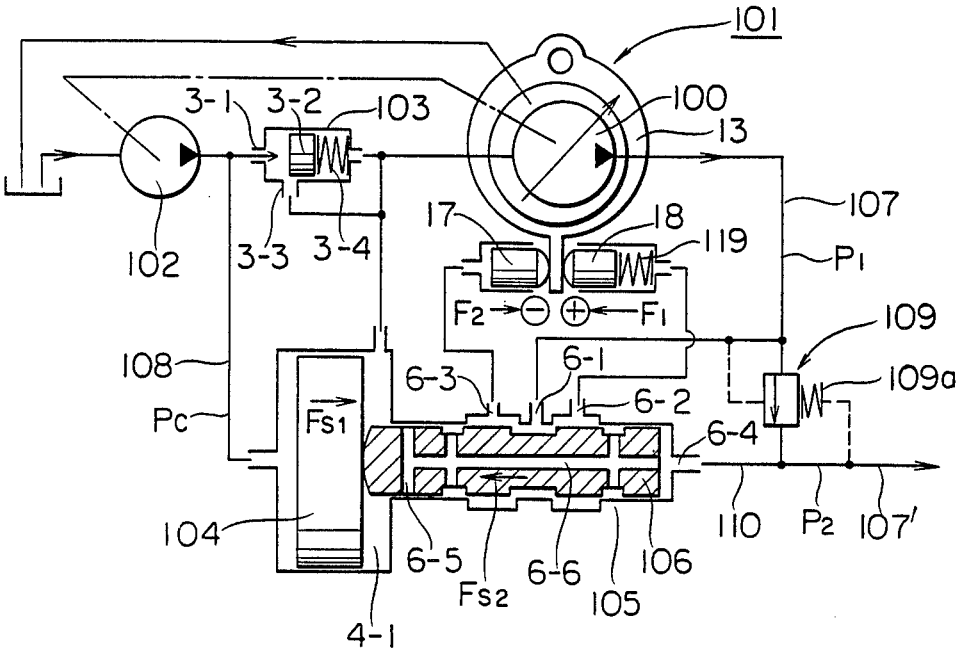
FIG. 1 is a circuit diagram of an oil-hydraulic system according to a first embodiment of the invention.

With reference to FIG. 1, there is shown a control apparatus for a variable displacement pump. This control apparatus includes a variable displacement pump 101, an eccentric ring 13 acting as a control element, an increase piston 17, a decrease piston 18, a feed pump 102 of the fixed displacement type and a regulator valve 103, which constitute means for generation of pressures proportional to the rotational speed, a spool valve 105 acting as a directional control valve, a balance piston 104 acting as means for providing a biasing force to be applied to the spool valve, and a pressure differential regulator 109.

First, the construction and operation of the variable displacement pump of the radial piston type will be described by referring to FIGS. 2 through 4.

A drive shaft 1 is journalled for rotation by bearings 3 mounted in the housing 2. The drive shaft 1 has its right end, as viewed, connected through a joint 4 to a shaft portion 6 formed at the left end of a rotor 5.

The rotor 5 carries seven (7) radial pistons 7 therearound for slidable reciprocation in respective cylinder bores formed in the rotor 5, and is rotatable about the axis of a stationary pintle or valve spindle 8 formed integrally with the housing 2. Each piston 7 is biased by its associated spring 9 outwardly of the rotor 5, the radially outermost end of the piston 7 being in constant contact with a cam ring 11 through the intermediacy of a shoe 10. The inner and outer peripheries of the cam ring are encircled through a plurality of rollers 12 by an eccentric ring 13. The eccentric ring 13 is pivoted at its upper portioh for oscillatory movement about a pin 14 secured in the housing. In the lower portion or in diametrical opposition to the pin 14, the eccentric ring 13 is provided with an integrally formed plate projection 15 which is slidably engaged in a slit 16' formed in a slider 16.

The slider 16 is disposed within the housing 2 for slidable movement substantially in parallel to the rotational axis of the rotor 5 and the axis of the stationary pintle 8. The slit 16' and the plate 15 are disposed with a predetermined small angle to the sliding direction of the slider 16.

The slider 16 is abutted at the right by the decrease piston 17 while being abutted at the left by the increase piston 18. The increase piston 18 and the slider 16 are normally biased to the right by a spring 19 having a minor biasing force. The increase and decrease pistons 17 and 18 are slidable in line with the slider 16. In this arrangement, it is designed that the slider 16 moves upon the presence of any difference in urging forces against the slider between the two pistons. Hydraulic pressures acting to the rear, of the decrease and increase pistons 17 and 18 are controlled in direction by the spool valve 105 to be described later.

In the housing 2, there are provided an inlet port 20 through which fluid delivered from the feed pump 102 flows in, as will be described later, and an outlet port 21 for delivery of fluid under pressure. The housing also provides therein a connection opening 23 for communicating the inlet port 20 with an inner cavity 22 formed in the housing 2. The cavity 22 is provided with a relief port 24 in fluid communication with the tank.

Next, the operation of the pump will be described. When the rotor 5 rotates around the stationary pintle 8, the cam ring 11 rotates in the same sense as the rotor because of frictional forces occurring between the ring 11 and the abutting shoes. If the rotational center of the cam ring 11 then is eccentric with respect to the axis of the pintle 8, each piston 7 reciprocates twice that eccentricity in relation to the rotor 5 under the action of the spring 9 and the cam ring 11.

Figure 4:
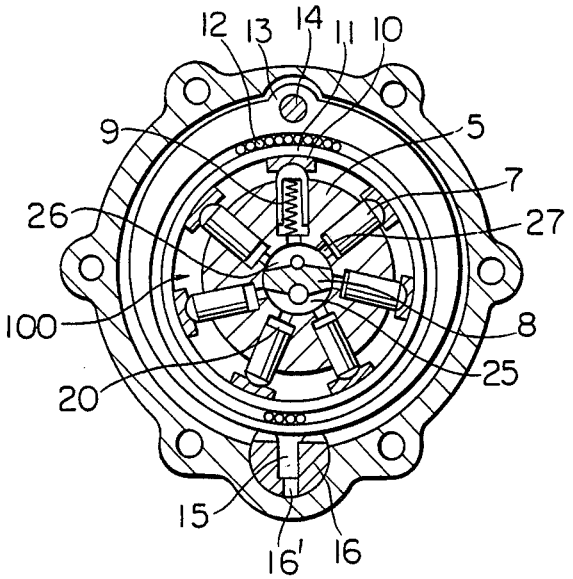
FIG. 4 is a cross-sectional view of the variable displacement pump taken along line IV—IV of FIG. 2, FIGS. 5A through 5C are schematic views for illustrating operations of a spool valve 105.

Accordingly, when the rotor 5 rotates clockwise as viewed in FIG. 4, fluid is drawn in the pumping chamber through a suction port 25 in the lower half zone of the pump and is delivered to a discharge port 26 through the chamber 27 in the upper half zone of the pump. That is, the fluid fed in through the inlet 20 is carried through the port 25, the pumping chamber 27, the port 26 and the outlet 21, and thence to a not shown load through the pressure line 107. In this fluid flow, surplus fluid which has not been drawn in the pump is exhausted through the opening 23, cavity 22 and thence through the relief port 24 into the tank while it cools moving parts within the housing 2. The displacement of the rotor 5 per revolution is determined by a volumetric change of each pumping chamber 27, i.e. the extent of reciprocation attained by the piston 7 or the amount of eccentricity between the cam ring 11 and the rotor 5. The positioning of the cam ring 11 and the eccentric ring 13 is determined by the slider disposed in engagement with the plate 15 integral with the eccentric ring 13.

Figure 2:
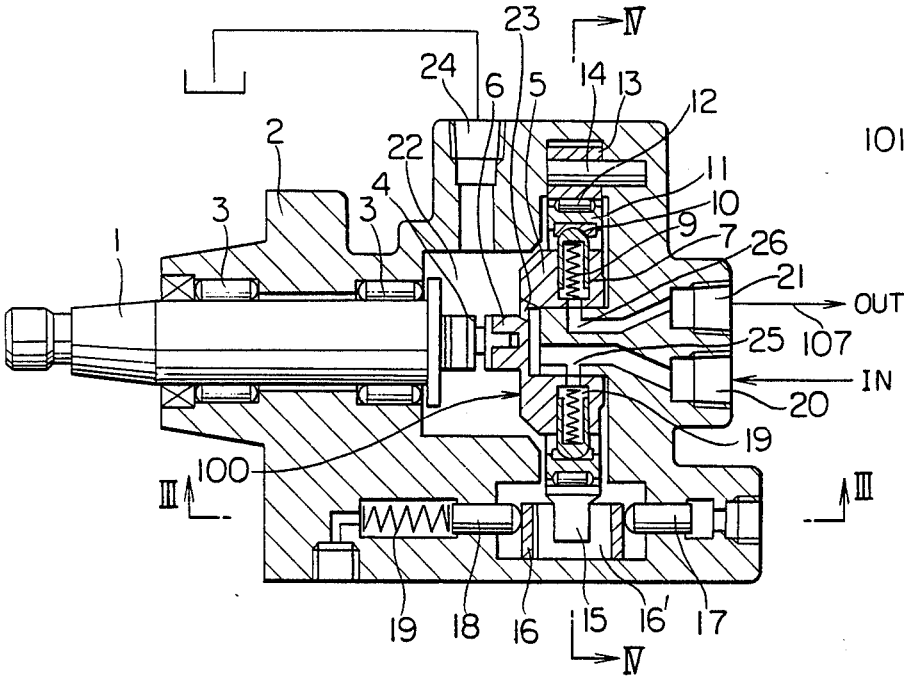
FIG. 2 is a longitudinal sectional view of a variable displacement pump 101 in FIG. 1.
Figure 3:
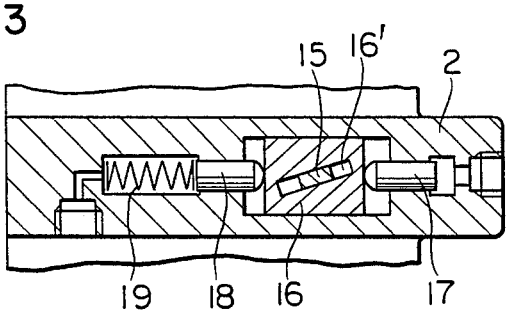
FIG. 3 is a fragmentary sectional view taken along line III—III of FIG. 2.

When the pump is at rest, the slider 16 is urged into its right terminal position by the biasing force of the spring 19 (however, it is shown in FIGS. 1 and 2 as placed in the intermediate position). Hence, the plate 15 is positioned at the left end of the slit 16' as viewed in FIG. 3, so that the eccentric ring 13 is given a maximum eccentricity with respect to the rotor 5. In this situation, the pump is in a position to be able to provide a maximum output.

Then, as the rotor 5 rotates to start the pumping action, the output pressure in the line 107 is raised. Hereupon, the spool valve 105 to be described later is actuated so as to switch over fluid flows to respective oil chambers behind the decrease and increase pistons 17 and 18 for the displacement control.

Upon switching-over of fluid supplies by the spool valve 105 with the result that a leftwise force, as viewed in FIG. 2, of the decrease piston 17 overcomes a rightwise force of the increase piston 18 plus the spring 19, the slider 16 is moved to the left. On this occasion, since the plate 15 is allowed to move perpendicularly of the axis of the eccentric ring but is restrained from axial movement, the positioning of the plate being engaged is moved relatively in the slit 16' in the right direction. Because of the slit 16' being inclined at a predetermined small angle to the axial direction, the plate 15 is caused to move to the right as viewed in FIG. 3. In consequence, the eccentric ring 13 integral with the plate 15 oscillates counterclockwise as viewed in FIG. 4 thereby decreasing the extent of eccentricity between the rotor 5 and the eccentric ring 13 and hence the pump output.

When actuating the spool valve 105, so that the rightward force exerted by the increase piston 18 and the spring 19 becomes greater than the leftward force by the decrease piston 17, the slider 16 is moved to the right i.e. opposite what has been described above. Then, the eccentric ring 13 oscillates counterclockwise, in FIG. 4, thereby increasing the degree of eccentricity between the rotor 5 and the ring 13, and hence the pump output.

Now, the further composite elements of the delivery control apparatus for a variable displacement pump will be described by reference to FIG. 1.

The feed pump 102 is disposed coaxially with the variable displacement pump 101, and the two of them are rotatingly driven by a not shown engine e.g. a diesel engine. This feed pump 102 is preferably a vanetype pump installed within the housing 2 of the pump 101, but it may alternatively be of other types e.g. gear-type, piston-type, etc. It is designed that the pump 102 delivers a volume of fluid proportional to the rotational speed of the engine, and its delivery pressure is lower than that of the pump 101 while its output being greater than input of the pump 101.

The regulator valve 103 is a pressure control unit which acts to develop a pressure Pc (hereinafter referred to as "control pressure Pc").

Fluid delivered from the feed pump 102 flows into the regulator valve 103 through an inlet 3-1, and urges a piston 3-2 rightward against a spring 3-4, thereby varying the sectional area of an outlet opening 3-3. In this arrangement, the control pressure Pc is determined approximately in proportion to the flow of fluid i.e. a speed of rotation Np of the pump 102 upon appropriate selection of the sectional shape of the outlet 3-3 and the spring constant of the spring 3-4. It is noted that a part of the fluid which was passed through the outlet 3—3 of the regulator valve 103 is fed into the variable displacement pump 101, the surplus fluid being carried to the tank through the relief opening 24.

The control pressure Pc, which is developed by the combined unit of the feed pump 102 and the regulator valve 103 constructed as above, is applied via a control line 108 to the left side, as viewed in FIG. 1, of the balance piston 104.

The spool valve 105 is a 4-way valve of known design for directional control of the fluid flow. The right end of the spool 106 is subjected to a pressure $P_2$ downstream of the pressure differential regulator 109 provided in the pressure line 107. The left end of the spool 106 is in abutment with the balance piston 104. The surface area of the balance piston 104 upon which the above-described control pressure Pc acts is selected greater than that of the right end of the spool 106 such that there will be provided a greater force $Fs_1$ by use of the control pressure Pc of relatively low pressure.

The spool valve 105 has its inlet port 6-1 communicated with the pressure line 107 upstream of the pressure differential regulator 109 while having its outlet port 6-4 communicated with a line 107' via a pilot line 110. The spool valve 105 also has control ports 6-2 and 6-3 in communication with the back chamber behind the increase piston 18 and that of the decrease piston 17, respectively. Still also, the spool valve is formed integrally with an outlet passage 6—6 in communication with the pressure line 107' downstream of the regulator 109, and a relief passage 6-5 adapted to be connected to the low pressure side when a pressure $P_2$ of the line 107' rises rapidly over a predetermined level. It is noted that in FIG. 1 the spool 106 of the valve 105 is shown in its neutral position.

Between the pressure lines 107 and 107' is interposed the pressure differential regulator 109, which is actuated to open or close the line 109 under the influence of pressure differentials between the upstream and downstream sides and a spring 109*a* such that pressure differential maintains at $\Delta P$. For purpose of illustration, the output pressure of the line 107 upstream of the regulator 109 is indicated by $P_1$ while that of the line 107' downstream is indicated by $P_2$ (this equals $P_1$ minus $\Delta P$).

With the construction so far described, the control system of the invention operates as follows.

The variable displacement pump 101 when at rest is held in position for a maximum pump delivery by the action of the spring 19, and as the pumps 101 and 102 are rotatingly driven by the common external engine both of the pumps commence fluid delivery actions.

Fluid from the feed pump 102 is taken in by the variable displacement pump 101 via the regulator valve 103 while being conducted via the control line 108 under the pressure Pc to urge the balance piston 104 providing a force $Fs_1$ acting rightward. Fluid discharged from the variable displacement pump 101 is supplied under the pressure $P_2$ to a not shown load through the line 107' downstream of the pressure differential regulator 109. The output pressure $P_2$ of the line 107' is also fed back via the pilot line 110 to the spool 106 thereby providing a leftward directed force $Fs_2$. Thus, the spool 106 moves into a position where the two opposed forces balance with each other.

Figure 5A:
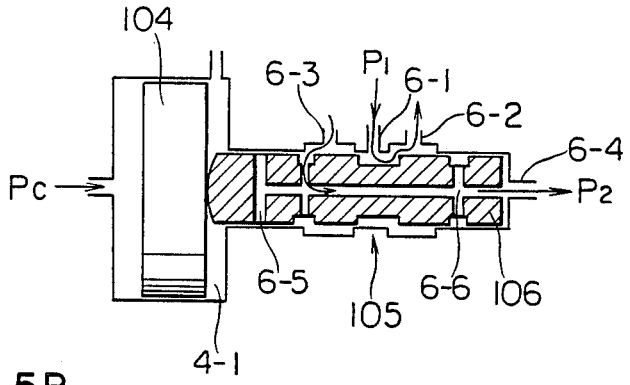

As the not shown drive engine increases its speed of rotation, the control pressure Pc is raised by the action of the pump 102 and the regulator valve 103, as described earlier, so that the balance piston 104 and the spool 106 moves rightward as shown in FIG. 5A. Hereupon, this spool movement results in fluid communication of the back chamber for increase piston 18 with the line 107 of $P_1$ through the control port 6-2 and the inlet port 6-1. At the same time, the back chamber for the decrease piston 17 is brought into fluid communication with the line 107' of $P_2$. Since the pressure $P_1$ is higher than the pressure $P_2$ by $\Delta P$, the leftward directed force $F_1$ acting upon the increase piston 18 surpasses the rightward directed force $F_2$ acting upon the decrease piston. In consequence, as described earlier, the eccentric ring 113 of the pump 101 increases the degree of eccentricity to increase the pump delivery, Which in turn results in rises of $P_1$ in the line 107 and $P_2$ in the line 107'.

Figure 5B:
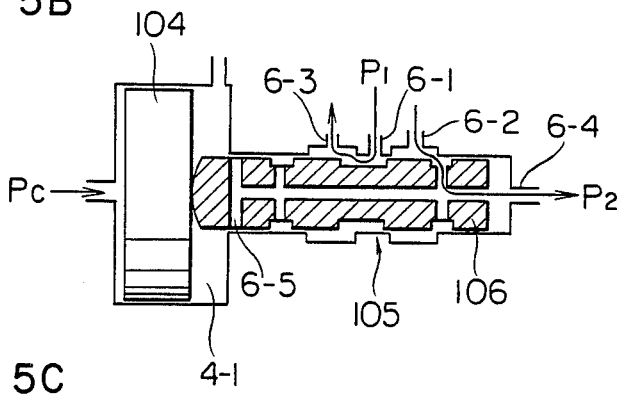

On the contrary, as the engine speed is decreased, the control pressure Pc is reduced thereby the balance piston 104 and the spool 106 being moved leftward as shown in FIG. 5B. Then, the chamber behind the increase piston 18 changes its fluid communication to the $P_2$ line 107' via the control port 6-2 and the outlet port 6-4. At the same time, the chamber behind the decrease piston 17 changes its fluid communication to the $P_1$ line 107. Hereupon, the rightward directed force $F_2$ exerted by the delivery pressure $P_1$ acting upon the decrease piston 17, by reason of the spring 19 being a minor bias, surpasses the leftward directed force $F_1$ by the delivery pressure $P_2$ acting upon the increase piston 18. Hence, the eccentricity of the ring 13 in the pump 101 now decreases to reduced the pump delivery, resulting drops in pressure of $P_1$ and $P_2$ in the lines 107 and 107', respectively.

Figure 6:
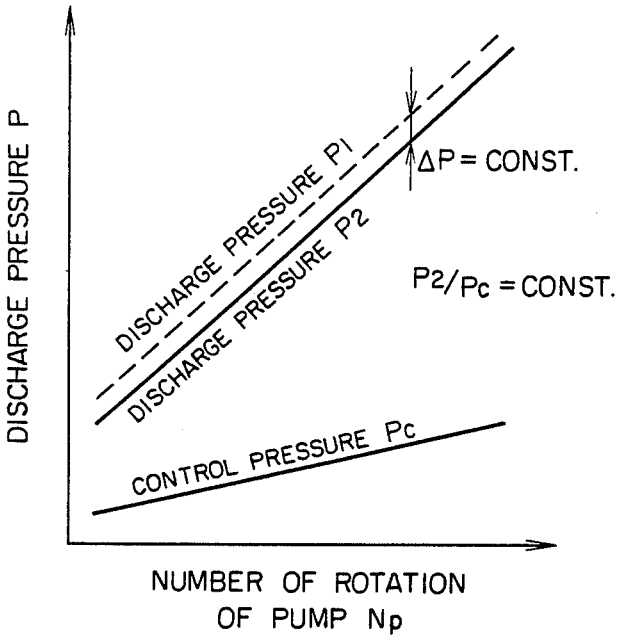
FIG. 6 is a graphic representation showing the characteristic relation of the pump speed of rotation Np versus the discharge pressure P, FIGS. 7 and 8 an fragmentary sectional views of the spool valve according to alternative embodiments of the invention.

Summarizing, as described in the foregoing, as the engine speed varies, the control pressure Pc varies accordingly, in response to which variation the delivery pressure $P_2$ of the line 107' is controlled. Since the control pressure Pc is approximately proportional to the r.p.m. of the feed pump 102 driven by the engine, the delivery pressure $P_2$ of the line 107' is controlled approximately in proportion to the r.p.m. of the feed pump 102, a constant of proportion being a ratio of pressure applied areas between the balance piston 104 and the spool 106, as shown in FIG. 6.

Next, assume that the engine speed maintains constant, thus the delivery pressures $P_1$ and $P_2$ of the lines 107 and 107', respectively, being as determined. If, in this situation, the not shown load varies in fluid consumption, then that variation causes a variation of the delivery pressure $P_2$ of the line 107'. This pressure change acts as a change of the leftward directed force $Fs_2$ acting on the spool 106 to move the latter When the load shows an increase in fluid consumption resulting in reduction of the delivery pressure $P_2$, the spool 106 moves to the right as shown in FIG. 5A to establish the port connection as described previously, so that the variable displacement pump 101 increases its output thereby the delivery pressures $P_1$ and $P_2$ being maintained at predetermined levels, respectively, upon compensation of them for the reduction. When, on the contrary, the load shows a decrease in fluid consumption resulting in elevation of the delivery pressure $P_2$, the spool 106 moves to the left as shown in FIG. 5B to establish the port connection as described previously, so that the variable displacement pump 101 decreases its output, whereby the delivery pressure $P_1$ and $P_2$ are maintained at predetermined levels, respectively, upon compensation the elevation.

Further, in such cases as when the not-shown load suddenly shows a zero fluid consumption (e.g. as at the time of a rapid fuel cut having been executed in the common-rail injection system), the pressure line 107 represents "blocked up" so that the delivery pressure $P_2$ tends to rise rapidly. At that time the control of the pump 101 to decrease the displacement does not catch up with such rapid rise up the delivery pressure $P_2$and, the pressure $P_2$ momentarily rises abnormally. This may result in occurence of breakdowns in high-pressure piping or line 107. That phenomenon is due to the fact that even if the spool 106 is shifted to a position as shown in FIG. 5B, the fluid captured in the chamber behind the increase piston 18 can not escape anywhere else, so that the piston 18 is hydraulically locked up to be unable to move rightward by the force $F_2$ of the decrease piston 17 (i.e. it is made impossible to decrease the pump output).

Figure 5C:
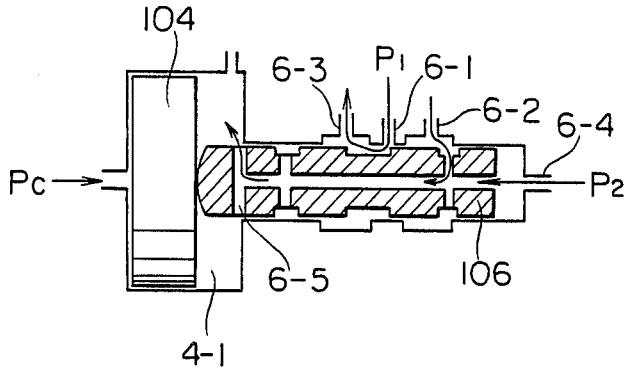

Under these conditions, however, the spool 106 moves leftward to a position as shown in FIG. 5C, upon rapid rising of the delivery pressure $P_2$ in excess of a predetermined level, where the relief port 6-5 is made upon in a low pressure chamber 4-1. Hence, fluid in the line 107' is emitted rapidly into the chamber 4-1 via the outlet port 6-4 to thereby reduce its pressure to a predetermined level.

In the embodiments described in the foregoing, text there is disclosed a method of controlling the delivery pressure $P_2$ by actuation of the spool valve 106 subject to a balance effect with the rightward directed force $Fs_1$ exerted by the balance piston 104. However, this force $Fs_1$ may be obtained otherwise than as described earlier, i.e. in a circuit for generating pressures proportional to the engine speed. For example, an output of the mechanical governor employed in a fuel injection pump may alternatively be used as $Fs_1$. In case the mechanical governor is used, that force $Fs_1$ is provided by amplification through a linkage of a force obtained from the control block, against the spring force, due to the centrifugal force of the flyweight proportional to the r.p.m. of the rotating shaft.

Figure 7:
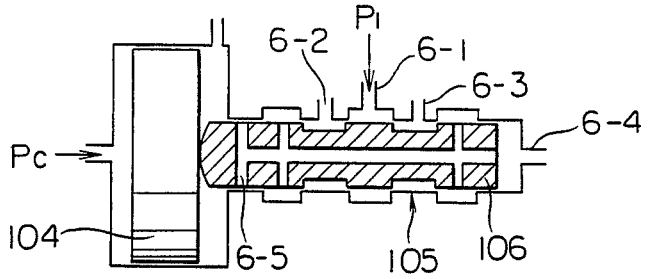
Figure 8:
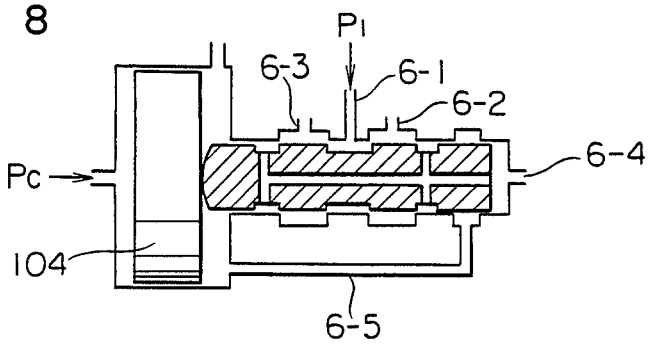

Though in the first embodiment of the invention the valve spool 106 of the 4-land type has been shown and described, it may be of the 3-land type as shown in FIG. 7, instead. Also, the relief port 6-5 for prevention of abnormal pressures in the line 107' may alternatively be provided externally of the spool valve 105, as shown in FIG. 8, though it has been described as provided internally.

Figure 9:
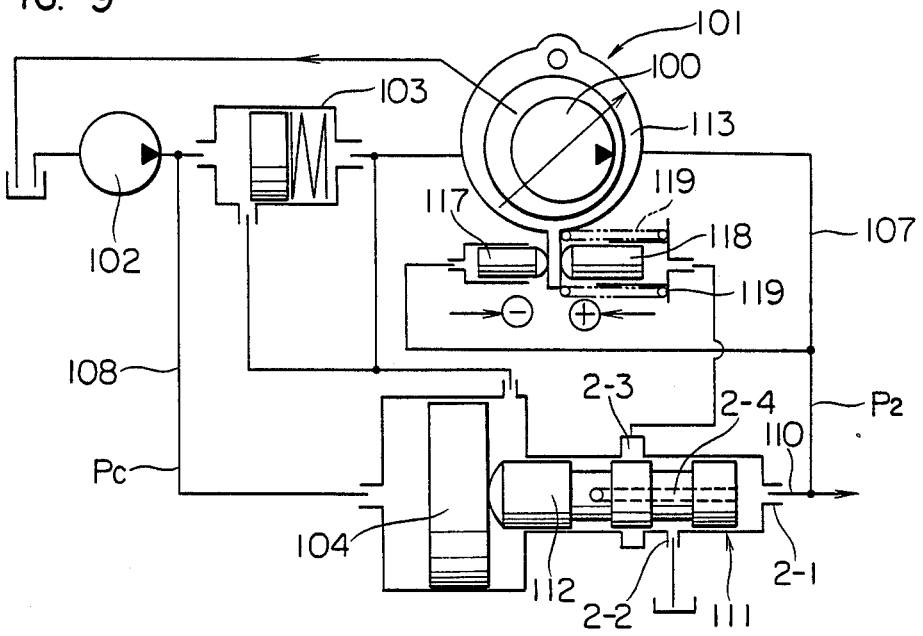
FIG. 9 is a circuit diagram of an oil-hydraulic system according to a further alternative embodiment of the invention.

Next, the second embodiment will be described with reference to FIG. 9. This differs from the first embodiment in that while the spool valve 111 is of the 3-way type, the pressure differential regulator 109 is omitted for direct supply of the pump output to the load. The spool type 3-way valve 111 has its inlet port 2-1, outlet port 2-2, and control port 2-3 communicated with the delivery pressure line 107, the tank, and the back chamber behind the increase piston 118, respectively. The spool 112 also is provided there through with a control passage 2-4. The chamber behind the decrease piston 17 is kept in direct communication with the pressure line 107 to be subjected to the delivery pressure $P_2$, the pressure applied area of the decrease piston 17 being selected smaller than that of the increase piston 118.

In the drawings, the same parts as in the first embodiment are identified by the same reference marks, and repetitive description is omitted.

The operation will now be explained. In the same manner as the first embodiment, the spool 112 shifts under the action of the control pressure Pc and the delivery pressure $P_2$ in the line 107 for performance of delivery pressure control. Specifically, when the control pressure Pc rises or the delivery pressure P2 is reduced, the spool 112 is moved rightward to bring the chamber behind the increase piston 118 into fluid communication, via the control port 2-3 and the inlet port 2-1, with the pressure line 107. Hence, the increase piston 118 is moved to the left by a pressure applied area differential between the decrease piston 117 and the increase piston 118. Rise of the pressure $P_2$ thus results. When, on the other hand, the control pressure Pc is reduced or the output pressure $P_2$ rises, the spool 112 moves leftward to bring the chamber behind the increase piston 118 into fluid communication via the control port 2-3 and the outlet port 2-2, with the tank. Hence, the decrease piston 117 is moved to the right by the delivery pressure $P_2$. Reduction of the pressure $P_2$ thus results.

In this manner, the fluid delivery of the variable displacement pump is controlled the same as the first embodiment.

The difference between the first embodiment and the second embodiment will now be explained briefly.

While in the first embodiment, the fluid to be used for displacement control flows to the pressure line 107 of $P_2$ through the outlet port 6-4 of the spool valve 105, in the second embodiment the same is released to the tank through the outlet port 2-1. Accordingly, the first embodiment is advantageous in that power consumption by the variable displacement pump is more economical since the volume of high pressure fluid, once pressurized, all are supplied to the line 107. In case of the delivery pressure P2 being at a high level, particularly, the first embodiment is superior to the second one in respect to power economy.

Figure 10:
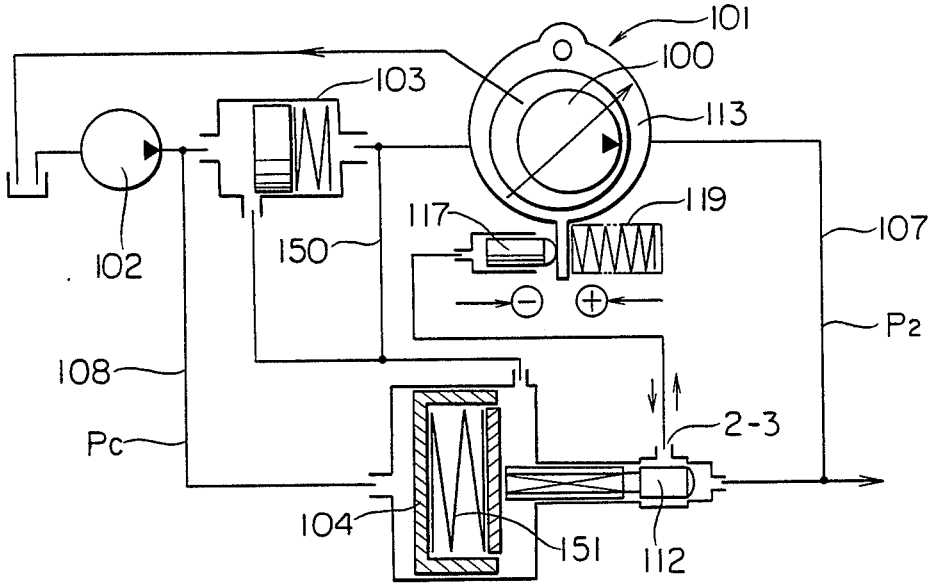
FIG. 10 is a circuit diagram, similar to FIG. 9, however according to a still further alternative embodiment of the invention.

Next, the third embodiment of the invention will be described with reference to FIG. 10.

Here, the embodied construction is similar to those of the preceeding two embodiments except that the pressure differential unit has omitted the increase piston 118 leaving the spring 119 alone for the increase, the displacement (eccentricity) control of the pump 101 being effected by applying the pressure $P_2$ to or releasing it from the increase piston 117.

When the control pressure Pc rises or the delivery pressure $P_2$ is reduced, the spool 112 moves rightward to cause the control port 2-3 to be shifted for communication from the line 107 to the suction line 150 of the pump. Hence, the force of the spring 119 overcomes that of the decrease piston 117 thereby increasing the pump displacement toward its maximum, which results in a rising of the delivery pressure $P_2$.

When, on the other hand, the control pressure Pc is reduced or the delivery pressure $P_2$ rises, then the spool 112 moves leftward to cause the control port 2-3 to be communicated with the delivery line $P_2$. Hence the force of the decrease piston 117 overcomes that of the spring 119 towards to the right, resulting in reduction of the delivery pressure $P_2$.

It is noted, in this embodiment, that in order to secure more rapid movement of the spool 112 and stabilization of the pressure control, there is additionally provided a spring 151 interposed between the spool 112 and the balance piston 104. This provision may equally be applied in the first and second embodiments.

In those embodiments so far mentioned, the variable displacement pump 110 has been described as of the radial rotary piston type, but it may alternatively be of the vane type. Also, the balance piston 104, as an alternative, may be integral with the spool valve.

In summary, according to the invention, as the drive engine increases its speed of rotation, the control pressure derived from the unit for generation of pressure proportional to the engine speed is raised and applied to one end of the directional control valve. As the valve moves, the fluid supplied to the displacement control unit are switched over from one to the other so that the pump delivery increases. Hence, the delivery pressure rises when the consumption by the load is maintained constant.

On the other hand, when fluid flow i.e. delivery pressure in the line from the pump to the load varies, where the speed of rotation i.e. the delivery pressure is to be maintained as predetermined, that pressure variation is applied via pilot line to the other end of the directional control valve. Hence, the valve actuates to switch over the fluid supplies to the pump displacement control unit to control the pump output, so that the pressure in the pressure line is maintained at a predetermined level. Accordingly, it is possible that as the engine speed varies from low to high, the pump delivery of the variable displacement pump will vary in response thereto from low pressure to high pressure and reaches a predetermined delivery pressure, while that predetermined delivery prressure is maintained in a reliable manner regardless of the displacement rate of the variable pump.

Additionally, according to the invention, for the eccentricity control between the rotor and the ring, either for increase or for decrease, which is based on the pressure differential across the regulator, the volume of fluid in the chamber behind the increase piston or the decrease piston flows to the pressure line downstream of the regulator. Hence, the amount of power consumption occuring in this control corresponds only to that pressure drop across the pressure differential regulator.

In contrast, according to the conventional control system, the delivery pressure when effecting the displacement control is reduced to the tank level, which results in extensive power consumption.

The difference of power consumption between the invention and the conventional are as described above is not so significant in case of low delivery pressures and less frequency of displacement control. However, when frequent controls are required under the condition of higher delivery pressures, the invention displays its feature of economy in respect to power consumption.

Figure 11:
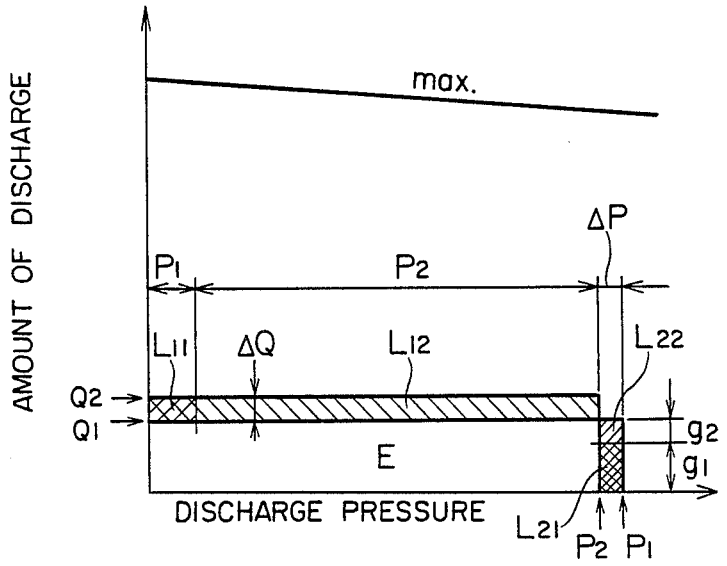
FIG. 11 is a graphic representation showing comparative power consumption between the variable displacement pump of FIG. 1 and the conventional pump.

The feature will be further described by reference to FIG. 11, wherein there is graphically shown a comparison of power consumption between the invention and the conventional system provided that the delivery pressure ($P_2$) and the amount of consumption ($Q_1$) respectively remain the same.

The area E represents the amount of power consumption in the above-described embodiment, which is expressed as the product of $Q_1$ (delivery of the pump 101) and $P_1$ (delivery pressure of the pump 101). The area $L_{21}$ out of E represents the amount of power consumed by the displacement control unit of decrease and increase pistons 17 and 18 being expressed as the product of the pressure differential $P_1-P_2$ and the fluid volume $Q_1$ required by the control unit. Also, $L_{22}$ represents the amount of power consumption due to a pressure drop ($\Delta P$) across the regulator 109. In contrast, according to the conventional control, the amount of power consumption is indicated by the product of the delivery $Q_2$, which is the sum of $Q_1$ and an addition $\Delta Q$ of pressure fluid for the displacement control purpose to be exhausted to the tank. Of this, the area $L_{11}$ represents the actual consumption of power occuring for displacement control by the control unit While the area $L_{12}$ representing the amount of power consumed when exhausting the pressure fluid after having once used to displacement control. As will be apparent from the graph, according to the conventional unit, the higher the delivery pressure $P_2$ required by the load becomes, the greater the amount of additional power consumption ($L_{12}$) becomes. Contrarily, in the embodiment of the invention, the additional power consumption ($L_{21}$) is small even in case of the delivery pressure $P_2$ being higher. Hence, the invention can secure the substantial effect of power saving.

What is claimed is:

1. A control apparatus for a variable displacement pump which comprising:

a variable displacement pump rotatingly driven by an external engine;

means for varying an amount of displacement of said pump;

valve means for switching operational fluid which is to be applied to and to operate said varying means;

means for generating a control pressure the magnitude of which is proportional to the rotational speed of said external engine;

means for transducing the control pressure from said generating means into a force and for applying said force to one end of said valve means;

a discharge line connecting said discharge port of said pump with an external load;

a pilot line branched off from said discharge line into said valve means for applying a pressure in said discharge line to the other end of said valve means; and said transducing means including a balance piston having a detecting surface to which said control pressure from said generating means is applied and an opposite surface contacting the valve means, and wherein the area of said detecting surface is greater than the area of the other end of said valve means.

2. A control apparatus for a variable displacement pump which comprising:

a variable displacement pump rotatingly driven by an external engine;

means for varying an amount of displacement of said pump;

valve means for switching operational fluid which is to be applied to and to operate said varying means;

means for generating a control pressure the magnitude of which is proportional to the rotational speed of said external engine;

means for transducing the control pressure from said generating means into a force and for applying said force to one end of said valve means;

a discharge line connecting said discharge port of said pump with an external load;

a pilot line branched off from said discharge line into said valve means for applying a pressure in said discharge line to the other end of said valve means;

said generating means including an additional pump having a stationary displacement thereof driven by said external engine, and a regulator means for generating a control pressure a magnitude of which is proportional to an amount of displacement of said additional pump; and said transducing means including a balance piston having a detecting surface to which said control pressure from said generating means is applied and an opposite surface contacting the valve means, and wherein an area of said detecting surface is greater than an area of the other end of said valve means.

3. A control apparatus for a variable displacement pump which comprising:

a variable displacement pump rotatingly driven by an external engine;

means for varying an amount of displacement of said pump;

valve means for switching operational fluid which is to be applied to and to operate said varying means;

means for generating a control pressure the magnitude of which is proportional to the rotational speed of said external engine;

means for transducing the control pressure from said generating means into a force and for applying said force to one end of said valve means;

a discharge line connecting said discharge port of said pump with an external load;

a pilot line branched off from said discharge line into said valve means for applying a pressure in said discharge line to the other end of said valve means; and said variable displacement pump comprising a rotor rotatably housed in a housing and an eccentric ring disposed within said housing for enclosing said rotor;

said varying means comprising a first piston acting onto said eccentric ring to increase an eccentricity between a center of said eccentric ring and a fixed center of rotation of said rotor and a second piston acting onto said eccentric ring to decrease said eccentricity;

said control apparatus further comprising a pressure difference regulator disposed in said discharge line for maintaining a pressure difference between a first pressure in a portion of said discharge line upstream from said regulator and a second pressure in a portion of said discharge line downstream from said regulator constant; and said valve means including a switching valve operated by a pressure introduced from said discharge line as a pilot pressure, and said switching valve switches an application of said first pressure from said first piston to said second piston and an application of said second pressure from said second piston to said first piston.

4. A control apparatus according to claim 3, wherein said switching valve is four-way valve having a spool therein, and said spool is provided therein with an outlet passage which is communicated with the portion of said discharge line downstream from said pressure difference regulator.

5. A control apparatus according to claim 3, wherein said first piston is provided with an associated urging means urging said first piston in a direction along which said eccentric ring is moved apart from said rotor to increase the eccentricity therebetween.

6. A control apparatus according to claim 3, wherein said transducing means includes a balance piston having a detecting surface to which said control pressure from said generating means is applied, and wherein an area of said detecting surface is greater than an area of the other end of said valve means.

7. A control apparatus according to claim 3, wherein:

said generating means includes an additional pump having a stationary displacement thereof driven by said external engine, and a regulator means for generating a control pressure a magnitude of which is proportional to an amount of displacement of said additional pump.

8. A control apparatus according to claim 3, wherein said switching valve is provided with a relief passage through which said second pressure is released to a lower pressure side when a pressure in said discharge line is raised over a predetermined value.

9. A control apparatus according to claim 8, wherein said switching valve is a four-way valve having a spool therein, and said spool is provided therein with an outlet passage which is communicated with the portion of said discharge line downstream from said pressure difference regulator.

10. A control apparatus according to claim 3, wherein said generating means includes an additional pump having a stationary displacement thereof driven by said external engine, and a regulator means for generating a control pressure a magnitude of which is proportional to an amount of displacement of said additional pump.

11. A control apparatus according to claim 10, wherein said transducing means includes a balance piston having a detecting surface to which said control pressure from said generating means is applied, and wherein an area of said detecting surface is greater than an area of the other end of said valve means.

* * * * *